US005382866A

United States Patent [19]

Boggasch et al.

[11] Patent Number: 5,382,866

[45] Date of Patent: Jan. 17, 1995

[54] METHOD OF FOCUSING A CHARGED PARTICLE BEAM AND PLASMA LENS THEREFOR

[75] Inventors: Ekkehard Boggasch, Grosszimmern; Andreas Tauschwitz, Wiesbaden, both of Germany

[73] Assignee: Gesellschaft für Schwerionenforschung mbH, Darmstadt, Germany

[21] Appl. No.: 57,741

[22] Filed: May 5, 1993

[30] Foreign Application Priority Data

May 6, 1992 [DE] Germany ..... 4214417

[51] Int. Cl.[6] ..... H01J 25/00; H01J 23/00; H05H 7/00; H05H 1/24

[52] U.S. Cl. ..... 313/231.31; 250/396 ML

[58] Field of Search ..... 313/631, 361.1, 157, 313/160, 155, 634, 231.61, 231.71, 231.31; 315/14, 5.34, 5.35, 5.39, 382, 382.1; 250/396 ML, 396 R

[56] References Cited

U.S. PATENT DOCUMENTS 3,678,323 7/1972 Osher et al. ..... 313/231.71

FOREIGN PATENT DOCUMENTS 404280043 10/1992 Japan ..... 315/5.35

*Primary Examiner*—Edward L. Coles, Sr.
*Assistant Examiner*—Jerome Grant, II
*Attorney, Agent, or Firm*—Klaus J. Bach

[57] ABSTRACT

In a method of focusing a beam of charged particles by means of a magnetic field which is generated by a current flowing through a plasma volume contained by an insulating tube extending between two opposite annular electrodes which produce the current in a pulsed form, the insulating tube has, with respect to the cross-section of the particle beam which passes therethrough a diameter so selected that the tube wall is disposed adjacent the limit of the penetration depth of the magnetic field into the plasma as constricted solely by the magnetic field generated between the electrodes.

4 Claims, 1 Drawing Sheet

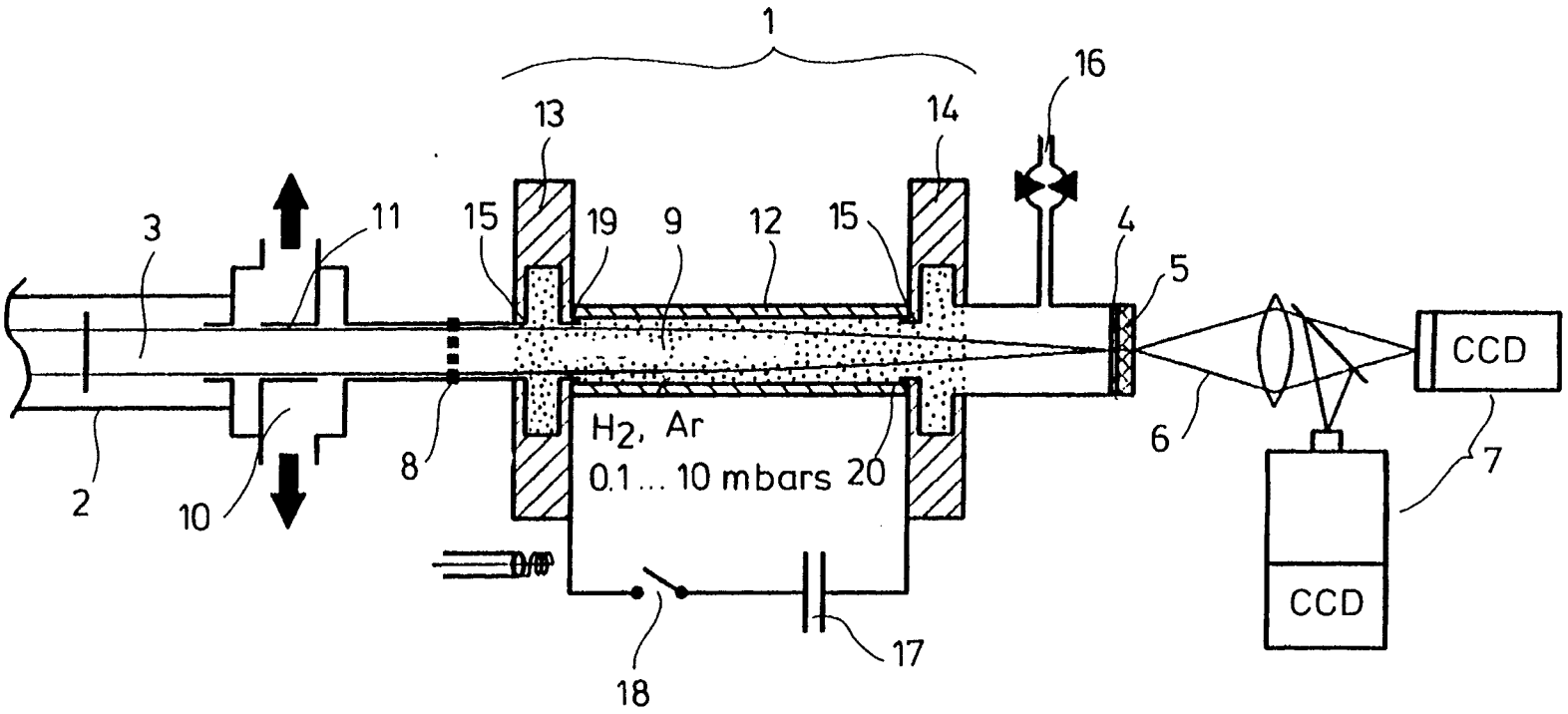
CCD
CCD
7
6
5
4
16
14
15
20
17
1
12
9
19
13
15
8
11
10
3
2
18
H2, Ar
0.1 ... 10 mbars

METHOD OF FOCUSING A CHARGED PARTICLE BEAM AND PLASMA LENS THEREFOR

BACKGROUND OF THE INVENTION

The present invention relates to a method of focusing a charged particle beam and to a plasma lens for focusing a charged particle beam in accordance with the method, preferably for the collection of divergent rays for the transmission and focusing of charged particle beams which are generated in an accelerator and which are focused by means of a magnetic field produced by current flow through a plasma.

The present invention is generally concerned with a space-charge compensating transmission and the fine-focusing of high-flux charged particle beams by means of a magnetic lens which has a linear mapping characteristic of the first order in both planes transverse to the beam at the same time. For beam transmission and focusing of charged particle beams, electric and magnetic quadrupoles have been used exclusively so far. Quadrupoles however have the disadvantage that they focus only in one plane while, at the same time, they de-focus in the other plane. Focusing of a beam in both planes can be achieved with this type of lens only by a serial arrangement of several quadrupoles (multiplets). Furthermore, the focusing strength of quadrupoles is limited by the field strength achievable at the pole piece.

Magnetic horns and wire lenses are special lenses which provide for strong focusing in both planes. The magnetic horn provides for focusing in both planes at the same time but it has no linear characteristics of representation. This results in partial absorption and scattering of the beam to be focused. It is used therefore almost exclusively for the collection of divergent rays.

Plasma lenses are a special type of wire lens wherein the conductive material, that is, the "wire", is represented by highly conductive plasma through which a high current is pulsed. The practical realization of such lenses however is very involved and expensive. The large axial current pulses cause, during discharge, a constriction of the plasma in a direction normal to the z-axis (the longitudinal axis of the beam), the so-called z-pinch, which, for a plasma lens, should coincide with the maximum current flow. At the same time, various instability modes are rapidly developing which limit the duration of the pinch and accordingly the focusing effects. It is further noted that although the known plasma lenses are capable of generating high magnetic fields, they achieve only limited accuracy of field linearity in the plasma.

A plasma lens of the type described herein is known from "PHYSICAL REVIEW LETTERS", Vol. 66, No. 13, p. 1705 ff. The plasma lens described in this article is based on the z-pinch discharge phenomenon and requires, for the ionization of the gases for the acceleration of the plasma, a relatively high amount of primarily stored energy which counteracts a fast pulse operation. Furthermore the location of the pinch axis as well as the timing of the pinch are subject to a certain lack of focus (jitter) because of rapid dynamic changes. With a z-pinch discharge the largest amount of energy stored in the condenser arrangement is utilized to compensate for the gas or the plasma. With the arrangement referred to above the needed amount of stored energy was typically 7–10 KJ. This enormous amount of energy substantially limits the repeat frequency of the discharge to about 1/minute. However, for good focusing only the magnetic properties are important, the density of the plasma is of minor importance in this connection. The life of the pinches is, as already mentioned, limited by the plasma instabilities to no more than several 100 ns.

On the basis of the state of the art it is the object of the present invention to provide a novel focusing method which is independent of the z-pinch and to provide on the basis of the novel method a novel plasma lens which does not have the disadvantages pointed out earlier. In particular the current should flow through the whole discharge cross-section as homogeneously as possible without causing dynamic constriction of the plasma.

SUMMARY OF THE INVENTION

A method and apparatus for focusing a beam of charged particles by means of a magnetic field which is generated by a current flowing through a plasma volume contained by an insulating wall structure interconnecting two spaced opposite annular electrodes which produce the magnetic field generating electric current flow through the plasma in a pulsed fashion wherein the insulating wall structure has, with respect to the cross-section of the particle beam passing through the wall structure and the annular electrodes, a dimension so selected that the wall structure is disposed adjacent the limit of the penetration depth of the magnetic field into the plasma as constricted solely by the magnetic field generated between the electrodes.

With this novel method and the corresponding plasma lens following the principle of wall-stabilized discharge, the pinch phenomenon described earlier can be avoided in an advantageous manner. The plasma lens according to the invention has a high focusing quality as a result of the homogeneous radial current density distribution in the active plasma volume. This is achieved by adaptation of the discharge geometry to the skin depth of the discharge in the plasma and the diameter of the particle beam to be focused. The invention permits to minimize the energy requirements for the discharge and provides therefore for a high repetition frequency (up to 100 Hz) capability. The discharge duration usable for focusing can therefore be increased to several $\mu$s whereas plasma lenses according to the z-pinch principle typically reach only several 100 ns corresponding to the duration of the pinch.

BRIEF DESCRIPTION OF THE DRAWING

The sole FIGURE shows schematically an apparatus with a plasma lens utilizing the method according to the invention.

DESCRIPTION OF THE PREFERRED EMBODIMENTS

In order to achieve a high penetration performance of heavy ion beams in a material, an ion beam should be focused onto a target with the smallest possible focal spot. To achieve this with a given beam strength the beam must be directed onto the target with the largest possible conveyance angle. Aberrations should be very small. This is achieved by the lens which will now be described:

FIG. 1 shows a plasma lens 1 as an integral part of a beam guide system 2 of a generator (accelerator) which is not shown in detail but which generates a high-energy charged parallel particle beam 3 which in the given example produces, for example, 2.2 GeV $Au^{24-1}$ (11.4 HeV/amu). The particle beam 3 is to be focused onto a target by means of the plasma lens 1. For experimental purposes, in the present case a scintillator 5 is used as the target which comprises a thin plastic foil overlayed by a metal foil 4. The light emission 6 of the scintillator 5 is diagnosed by a camera system 7 which is not described in detail. To facilitate diagnosis, the beam 3 is divided into eight partial beams by means of a multi-opening diaphragm 8 which is arranged ahead of the plasma lens 1. The separate partial beams proceed unaltered through the plasma region 9 of the plasma lens 1. The vacuum maintained in the plasma region 9 is separated from the vacuum of the beam guide system 2 in a windowless fashion by means of a differential pressure evacuating section 10 which includes a circular opening 11 for the passage of the beam 3. The whole unit all the way to the target 5 is formed as an integral vacuum-tight system.

As already mentioned the plasma lens according to the invention operates according to the principle of wall-stabilized discharge. An essential element for achieving these effects is a cylindrical discharge container 12 preferably in the form of an insulating tube of quartz which, sealed by O-rings, is mounted resiliently between the two electrodes 13 and 14 so as to be in alignment with the beam system. The electrodes 13 and 14 are connected to a power supply unit which will be described later. Current flow in the plasma between the two electrodes 13 and 14 generates a magnetic field for focusing the particle beam 3.

At least one of the two electrodes needs to be electrically insulated from the potential of the beam guide system 2. This may be achieved galvanically, by means of an insulator, or inductively by providing a high inductivity compared to that of the generator. The electrodes 13 and 14 which are arranged in the beam guide arrangement behind the diaphragm 8 or the evacuating section 10 have passages 15 corresponding in size to the inner diameter of the tube 12 containing the plasma region 9. The operating gas to be ionized to become the plasma, in the present case Ar or $H_2$ under a pressure of 0.5 to 10 mbar, is admitted to the plasma region by way of a gas inlet 16. To reduce the discharge delay and to achieve improved timing (reduced jitter) a DC voltage glow discharge (1 mA) of a pulsed discharge (100 A) is utilized. The electric energy required for the discharge is stored in a condenser structure 17 and is supplied to the electrodes 13 and 14 by closing of the switch 18.

The diameter of the discharge container, that is, the quartz tube 12, is so selected that, based on the cross-section of the plasma when constricted only by the magnetic field under the same plasma conditions, the wall is disposed at a point expected to be reached by the skin depth of the discharge. Skin depth in this connection is to be understood as the limit for the penetration depth into the plasma of the electromagnetic field generated by the current between the electrodes. That is, in other words, the diameter of the quartz tube 12, for example, is just as large as, or smaller than, the diameter to which the skin depth of the magnetic field reaches. This measure provides in the tube 12 for a discharge which, in contrast to the z-pinch discharge, provides for a wall-stabilized plasma. As a result the current flows almost homogeneously through the whole discharge cross-section and dynamic constriction of the plasma (plasma pinch) does not occur. By triggering the plasma discharge concurrently with a beam pulse, the beam is focused with a large convergence angle and a small focus spot is generated.

In a successful experiment the energy stored in the condenser structure was about 65 J at 10 kV in a 1.3 μF condenser. This amount of energy is smaller by more than one order of magnitude than the energy required in an experiment with a plasma lens in accordance with the state of the art. The energy is required to generate the plasma in the plasma region 9, that is, to ionize the operating gas admitted via the inlet 16, without substantially increasing its density. Only during the start-up phase of the discharge a certain amount of plasma pinch is generated in relation to the axis which, however, is very small in relation to the tube diameter. The decay of this pinch by plasma instabilities causes, like with turbulence, a mixing of the discharge volume in the plasma and accordingly contributes to a homogeneous ionization of the whole discharge volume.

In order to achieve homogeneous ionization, which is a precondition for homogeneous current density, the skin depth of the discharge ($d_{skin}=T/\mu\sigma\pi)^{\frac{1}{2}}$), has to be adapted to the diameter of the particle beam to be focused and the diameter of the plasma tube as pointed out earlier. (In the given equation $\sigma$ stands for the conductivity of the plasma and T for the duration of the period of the discharge frequency.) With this measure, a homogeneous current density is achieved and the energy storage capacity of the condenser battery is fully utilized. In contrast to the z-pinch discharges, high repetition frequencies of up to 100 Hz can be achieved. In addition the duration of the discharge which is usable for focusing can be increased to several μs whereas the corresponding duration during z-pinch discharge is limited to only several 100 ns. The use of annular hollow electrodes 13 and 14 with sharp edges 19 and 20 further improves the discharge properties toward a homogeneous current density distribution.

The hollow electrodes 13 and 14 are provided with the sharp edges 19 and 20 at the inside thereby to provide for a high field strength and accordingly fast ionization of the gas. The sharp edges 19 and 20 form the limits of the inner diameter of the annular electrodes 13 and 14 in such a way that an excess field strength is generated adjacent the wall of the insulator tube 12 between the electrodes 13 and 14. This measure facilitates the inception of the current flow adjacent the wall.

Furthermore, in order to reduce the discharge delay and the timing inaccuracies of the inception of the current flow, the gas between the electrodes 13 and 14 is pre-ionized by means of a DC glow discharge of about 1 mA or a pre-discharge of several 100 A.

The insulator tube 12 is supported between the electrodes 13 and 14 by means of O-rings which also provide for a seal in order to obtain a certain resiliency thereby to prevent fracture of the insulator tube by forces occurring during the discharge for short periods of time.

The novel plasma lens provides for magnetic focusing of particle beams in both directions transverse to the beam. Space charges are compensated for in the plasma. Avoidance of the pinch effect results in improved time and spacial stabilities of the discharge and accordingly in improved focusing quality.

REFERENCE NUMERALS

1 Plasma lens
2 Beam guide
3 Particle beam

4 Target
5 Scintillator
6 Light emission
7 Camera system
8 Multi-opening diaphragm
9 Plasma region
10 Differential pressure evacuating section
11 Opening
12 Discharge container-quartz tube
13 Electrode
14 Electrode
15 Passage
16 Gas inlet
17 Condenser structure
18 Switch
19 Sharp edge
20 Sharp edge

What is claimed is:

1. A method of focusing a beam of charged particles by means of a magnetic field which is generated by a current flowing through a cylindrical volume of plasma which is contained between two electrodes by an insulating wall and in which a magnetic field is generated between the electrodes by a pulsed discharge current, wherein said magnetic field extends into the cylindrical plasma volume to a certain penetration depth defining a limit and the insulating wall is, with regard to a cross-section of said beam, specially so arranged that it is disposed adjacent the limit of the penetration depth of the magnetic field into the plasma when constricted only by the magnetic field, said discharge current providing a discharge having a start-up phase with a plasma pinch being generated only during the start-up phase of the discharge.

2. A plasma lens for focusing a beam of charged particles and for the transmission control and the collection of divergent particle beams of an accelerator, comprising a vacuum chamber for containing a plasma, annular electrodes arranged at opposite ends of the plasma chamber so as to permit passage of the beam through the electrodes, said electrodes being adapted to generate a current through the plasma in the vacuum chamber thereby to generate a magnetic force field for the beam extending therethrough, said vacuum chamber being defined by a cylindrical discharge container extending between said annular electrodes and sealed to them at their center openings, said discharge container being an insulating tube resiliently mounted in alignment with the center openings of said annular electrodes by means of O-ring seals and having a diameter which is smaller than the diameter to which the expected skin depth would extend, that is, to which an electromagnetic field would extend into a plasma solely constricted by the magnetic field generated by a pulsed discharge current established between the electrodes.

3. A plasma lens according to claim 2, wherein said insulating tube is a quartz glass tube.

4. A plasma lens according to claim 2, wherein said annular electrodes have an annular cavity and are provided with sharp inner edges adjacent said insulating tube.

* * * * *